United States Patent [19]

Owen, Sr

[11] 3,961,637

[45] June 8, 1976

[54] AGGREGATE MATERIALS WASHING APPARATUS

[76] Inventor: Clyde W. Owen, Sr, P.O. Box 368, Covington, Tenn. 38019

[22] Filed: Dec. 12, 1974

[21] Appl. No.: 532,033

[52] U.S. Cl. ..... 134/104; 134/83; 134/134; 134/159; 134/163

[51] Int. Cl.[2] ..... B08B 3/04; B08B 3/10

[58] Field of Search ..... 134/65, 78, 79, 83, 134/104, 110, 111, 120, 132–134, 155, 157, 159, 163

[56] References Cited

UNITED STATES PATENTS

| | | | |
|---|---|---|---|
| 2,185,408 | 1/1940 | Kettenbach | 134/78 X |
| 2,240,442 | 4/1941 | Paul | 134/104 UX |
| 2,392,911 | 1/1946 | Gaudet | 134/157 |
| 3,135,668 | 6/1964 | Wesson | 134/65 X |

*Primary Examiner*—Robert L. Bleutge
*Attorney, Agent, or Firm*—Lowe, King, Price & Markva

[57] ABSTRACT

Apparatus for washing aggregate material comprises a cylindrical drum including first and second end walls having central openings defining respectively an outlet and an inlet. The drum is inclined from the horizontal to provide flow of the aggregate material toward the outlet along the interior of the drum. The drum is mounted for rotation on its longitudinal axis, driven by a tangentially engaged chain and sprocket, and is supported and stabilized by a system of guide rolls. The drum contains a series of longitudinally extending agitator vanes spaced around the cylindrical inner wall of the drum. As the drum rotates, the vanes agitate the aggregate material in the presence of wash water for efficient aggregate cleaning. A series of scoop-shaped flume elements attached to and abutting the outlet end wall bodily rotate with the drum. The flume elements are imperforate and extend radially between the cylindrical inner wall of the drum and the outlet for pumping both wash and aggregate material to the outlet as the drum rotates. A wire mesh tail screen is connected to the outlet to dewater the washed aggregate delivered by the flume elements. A roller engages the outer surface of the tail screen to remove any aggregate pieces that might become jammed or stuck in the mesh. For minimum downtime, the agitator vanes and inlet end wall are attached to a replaceable liner element seated inside the drum. The interior of the drum may be promptly serviced by simply replacing the liner.

9 Claims, 6 Drawing Figures

FIG. 2
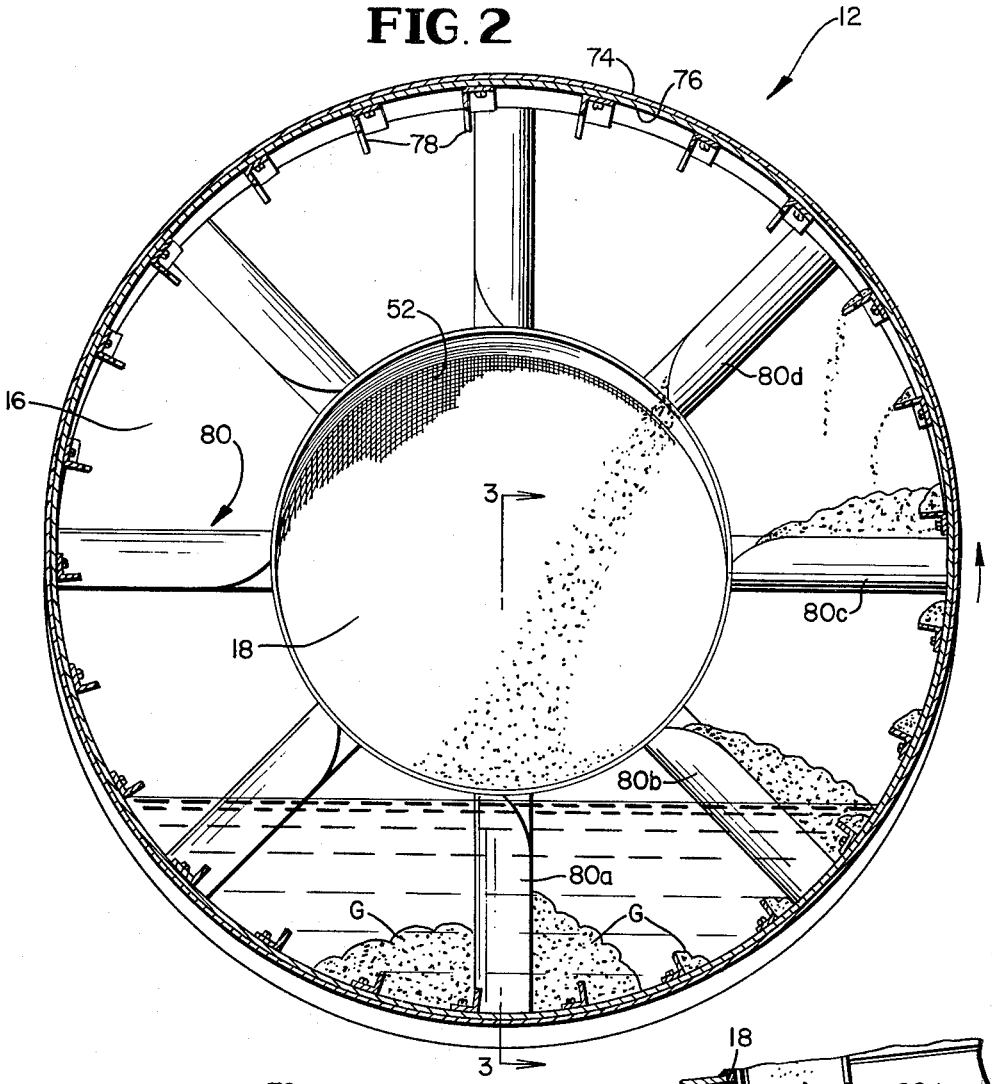
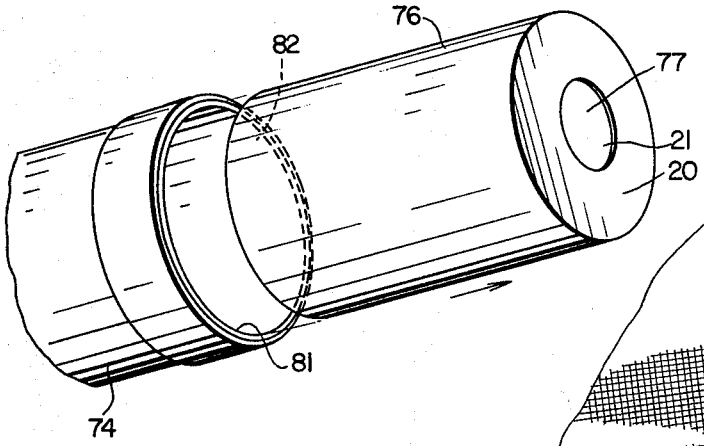
FIG. 4
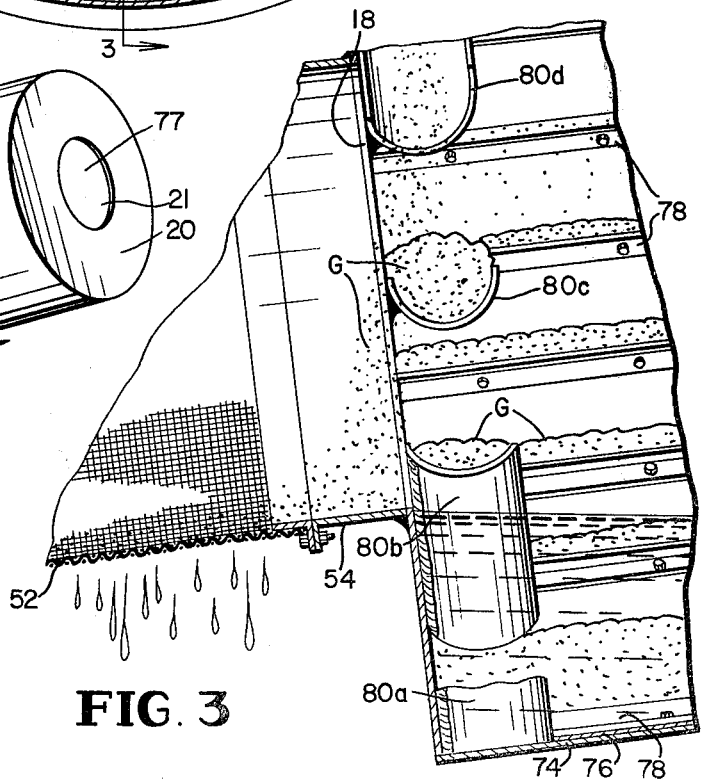
FIG. 3

AGGREGATE MATERIALS WASHING APPARATUS

The present invention relates to aggregate material washing apparatus and, more particularly, to an improved aggregate material washing apparatus that avoids wash water stagnation and freeze-up, and requires little routine maintenance.

BACKGROUND OF THE INVENTION

In aggregate material washing machinery, aggregate materials are typically passed through a rotating cylindrical drum and mixed with wash water or cleaning fluid. Generally, the cylindrical drum incorporates interior agitator elements that tumble the aggregate through the wash water as the drum rotates. After the aggregate is scrubbed in wash water it is transferred to a chute or conveyor.

While apparatus provided heretofore were generally somewhat satisfactory for the purpose intended, periodic maintenance is required. For example, typically the agitator elements on the interior of the drum become fouled and deteriorate during use and have to be periodically cleaned or replaced. This requires emptying the drum of aggregate and wash water and then cleaning or replacing each agitator element. Since each element is often bolted to the interior, the procedure is inconvenient and adds to the downtime of the apparatus.

As another disadvantage of the prior art, during operation wash water tends to accumulate in the interior of the drum. Even though the drum rotates, some of the water, particularly at the water surface, is not agitated by the internal elements of the drum. This is so because the agitator elements cut through the wash only at the inner wall of the drum; the surface of the wash not being sufficiently agitated thereby. The wash water becomes stagnate and loaded with silt reducing the cleaning efficiency. The water occasionally freezes during cold weather especially during overnight shutdown periods.

Thus, in the prior art, to prevent stagnation and/or freeze-up, the drum must be periodically drained especially at the end of the day during freezing weather. In the past, one proposal to alleviate the problem has been to provide spaced apertures in an end wall to continuously drain water during aggregate washing. However, the end wall apertures are undesirable insofar as they tend to drain excessive water at the start of a run, and then become clogged toward the end of the run. In freezing weather, the overnight residue invariably freezes around the apertures. The sediment in the water is not positively removed and thus prevents the efficient cleaning, and it must be manually removed the next day by a special maintenance crew. Also, the apertures weaken the end wall structure.

In the prior art, a cylindrical screen is sometimes provided at the outlet of the drum for simultaneously draining and transferring the aggregate to the output chute or conveyor. It often occurs that particles of aggregate become jammed in the screen and prevent efficient draining. Periodically, the apparatus has to be shut down for cleaning the screen further adding to downtime.

OBJECTIVES OF THE INVENTION

Accordingly, it is one object of the present invention to provide an aggregate materials washer designed to alleviate the above-identified problems of prior attempts and thereby to provide an improved aggregate materials washer.

It is another object to provide a washer whose operation is characterized by thorough scrubbing of the aggregate with minimum downtime due to maintenance.

It is another object of the present invention to provide an aggregate materials washer providing a continuous tumbling of the aggregate through wash water or cleaning fluid for thorough washing.

It is another object of the present invention to provide aggregate materials washer wherein stagnation or freezing of wash water is eliminated.

It is still another object of the present invention to provide an aggregate materials washer wherein dirty wash water is automatically pumped to an outlet and the aggregate separated therefrom during rotation of the drum.

It is yet another object of the present invention to provide an aggregate materials washer having an output screen that is self-cleaning to prevent pieces of aggregate from becoming lodged in the screen.

It is still another object of the present invention to provide an aggregate materials washer having a replaceable liner element for minimum downtime for major maintenance.

BRIEF DESCRIPTION OF THE PREFERRED EMBODIMENT

The aggregate materials washing apparatus of the present invention comprises a cylindrical drum having a combination of internal longitudinal agitator vanes and radial flume elements to tumble the aggregate through wash water for thorough cleaning. The drum includes first and second end walls with central openings defining respectively an outlet and an inlet. The drum is inclined from the horizontal to provide a gravity feed of the aggregate and water from inlet to outlet along the length of the drum interior. As the aggregate and water slide down toward the outlet, longitudinal agitator vanes, spaced around the interior wall of the drum tumble the aggregate through the wash water for thorough cleaning.

Abutting the end wall and turning with the drum is a plurality of scoop-shaped flume elements. The flume elements extend radially between the interior of the cylindrical drum wall and the outlet. The flume elements are imperforate for scooping up both aggregate and water. As the drum turns, the flume elements pump aggregate and slightly soiled water through the outlet to a cylindrical wire mesh tail screen. The tail screen dewaters the aggregate before delivery to a hopper or conveyor.

During washing, the radial flume elements stir the surface of the water in the drum. This action prevents the water from becoming stagnate or freezing during cold weather. By turning off the inflow of water and aggregate and continuing rotation of the drum, the pumping action of the radial flume elements automatically empties the drum at the end of a run.

The inlet end wall and longitudinal agitator vanes may be disposed on a replaceable liner element that is loaded into a carrier shell portion of the drum. The liner is conveniently removable from the carrier shell for inspection and repair or replacement. The liner obviates the necessity of removing the individual agitator vanes and the drum wall and minimizes downtime for maintenance.

A cleaning roller contacts the outer surface of the tail screen to remove any aggregate pieces that might become jammed in the mesh. This is accomplished by the roller pushing the pieces back through the mesh for release in a normal manner. The roller presses against the screen with its own weight and is mounted with a universal joint for yielding to irregularities on the screen.

The drive mechanism for rotating the drum comprises a motor driven chain that tangentially engages a drum drive sprocket. The tangential engagement provides adequate force for turning the drum while minimizing sprocket contact.

Tire guide rolls are maintained against the outer surface of the drum for vertical support and stabilization and against an annular guide flange on the girth of the drum to prevent longitudinal sliding.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects all without departing from the invention. Accordingly, the drawings and description are to be regarded as illustrative in nature, and not as restrictive.

BRIEF DESCRIPTION OF THE DRAWINGS

FIG. 2 is an end view of the apparatus of FIG. 1 showing the longitudinal agitator vanes and radial flume elements inside the drum;

FIG. 3 is a cross sectional view taken along line 3—3 of FIG. 2 showing the pumping action of the radial flume elements on aggregate material and water;

FIG. 4 is a partial perspective view of the replaceable drum liner removed from the drum;

DETAILED DESCRIPTION OF THE PREFERRED EMBODIMENT

Figure 1:
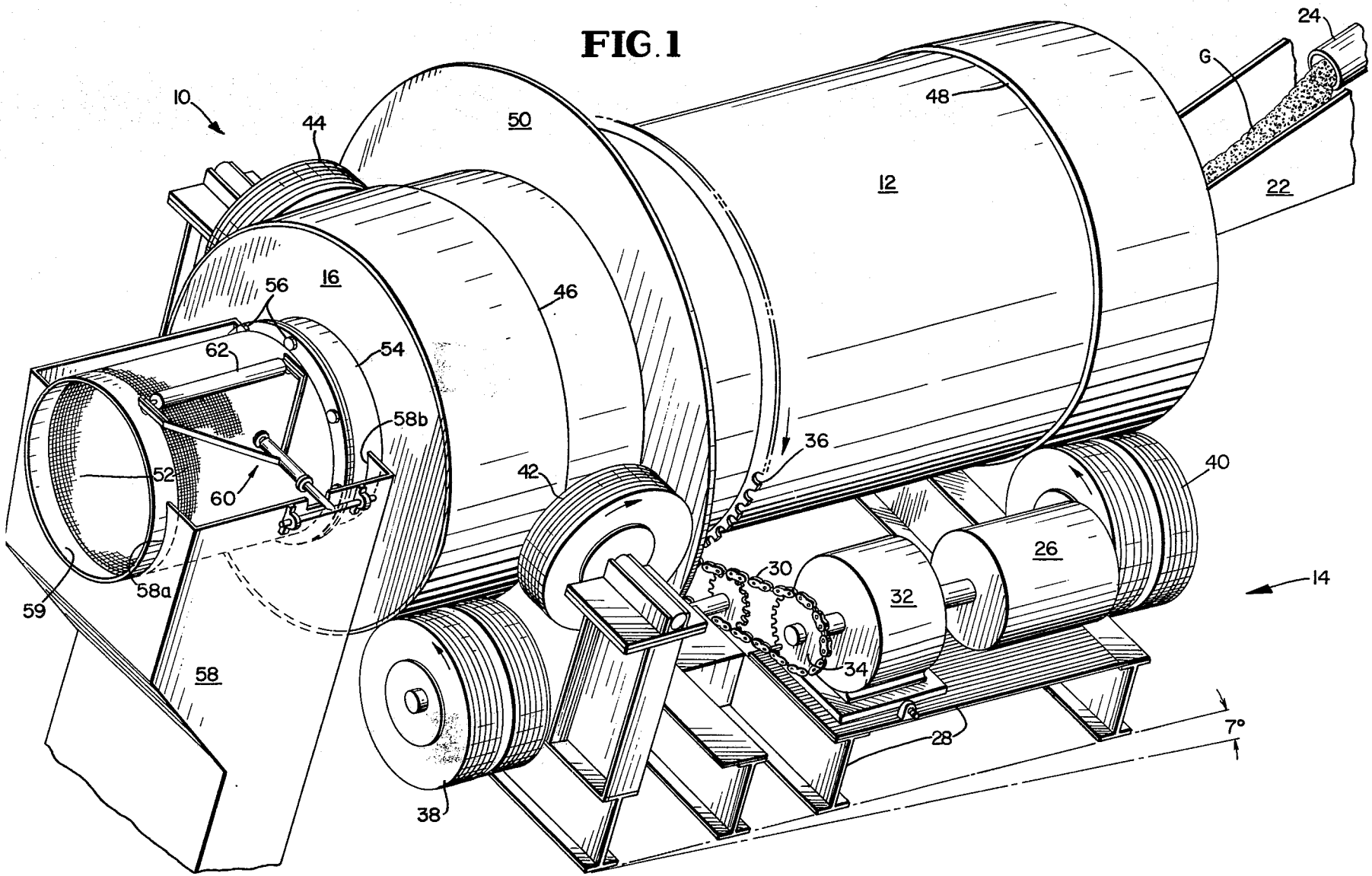
FIG. 1 is a perspective view of a preferred embodiment of the aggregate materials washing apparatus of the present invention.

With reference now to FIG. 1, there is shown in a perspective view an aggregate materials washing apparatus 10 constructed in accordance with the principles of the present invention. As shown in this figure, the aggregate materials washing apparatus 10 includes a cylindrical drum 12 that is horizontally supported on a drive assembly 14. The drum 12 is inclined at an acute angle of preferably about seven degrees from the horizontal to provide gravity flow of aggregate and wash water through drum 12 during operation. The drive assembly may be mounted on a cradle (not shown) to provide the desired incline.

The drum 12 contains a first end wall 16 having a central opening forming an outlet 18. At the opposite end of drum 12 a second end wall 20, similar to first end wall 16, contains an inlet 21 (see FIG. 4). Inlet 21 receives aggregate material and wash water or other cleaning fluid supplied by feed pipe 24 through hopper 22.

A drive motor 26, mounted on support platform 28, drives chain 30 through a conventional transmission 32 and drive sprocket 34. Drive chain 30 is guided along the lower surface of drum 12 to tangentially engage drum sprocket 36 connected around the girth of the drum. Additional guide sprockets 37 (only one shown) are mounted on the sides of the drum 12 to maintain the drive chain 30 in line with the drum sprocket 36.

Energy loss caused by friction from sprocket-chain engagement is minimized by this drive arrangement because only a few sprockets of drum sprocket 36 engage drive chain 30 at a time.

Drum 12 is supported and stabilized by tire guide rolls 38, 40, 42 and 44 mounted to support platform 28. Tire guide rolls 38 and 40 abut annular reinforcement rings 46 and 48 on drum 12 for vertical support of the drum. Additional tire guide rolls (not shown) also abut annular reinforcement rings 46 and 48 on the opposite side of the drum 12. Guide flange 50, secured around the girth of the drum 12 is engaged by tire guide rolls 42 and 44 to prevent the drum 12 from slipping axially off support platform 14. Thus, drum 12 floats on tire guide rolls, stabilized vertically and horizontally by the described guide roll arrangement, while being rotated by drive chain 30.

A collar 54 is formed around the outlet 18 on end wall 16 (see FIG. 1). Cylindrical tail screen 52 is connected to collar 54 with mounting bolts 56. The mounting bolts 56 permit the tail screen 52 to be easily removed for inspection or replacement.

The tail screen 52 which may be fabricated of a mesh material, such as expanded metal, functions to dewater the washed aggregate as it leaves the drum 12 through outlet 18. Chute 58, disposed directly below tail screen 52, collects the used wash water that has been drained from the aggregate. The wash water drains through the chute 58 downwardly to a suitable drain pipe (not shown) for disposal, thereby providing efficient means for collecting the dirty fluid after it has served its purpose in the aggregate washing apparatus. The actual type of drain used is optional and may be omitted except for convenience and efficiency in carrying water away from the machine. Chute 58 also provides some support and is sealed to tail screen 52 and drum 12 by being cradled around the tail screen 52 and collar 54 respectively at cut away portions **58*a* and 58*b*. The cleaned aggregate rolls along the full length of the rotating screen 52 and may be deposited on a suitable conveyor or chute (not shown) positioned under exit lip 59**.

A tail screen cleaning roller assembly 60 comprises a roller 62 provided in engagement with the outside upper surface of tail screen 52 to remove any aggregate pieces that might become jammed in the screen. This is accomplished by the roller 52 pushing the aggregate pieces back through the tail screen 52 for release in a normal manner. The cleaning roller 62 is urged against the outer surface of tail screen 52 by its own weight and a universal joint, described later in conjunction with FIGS. 5 and 6, permits the roller to yield to irregularities in the tail screen 52. This provides a following action for more efficient cleaning and prevents damage to the cleaning roller assembly.

In operation, aggregate material G and clean wash water are fed into the inlet aperture 20 of drum 12 through hopper 22. The drum 12 rotates counterclockwise (viewed looking toward inlet end wall 20) driven by drive motor 26, transmission 32 and drive chain 30. The aggregate slides and tumbles toward the lower end wall 16 due to the inclined orientation of the drum thereby providing the cleaning function as the water flows around and scrubs the aggregate pieces.

Forming an important aspect of the invention, internal agitator vanes 78 (FIGS. 2 and 3) cause the tumbling action to the aggregate for scrubbing with the wash water. The aggregate and water finally settle in the vicinity of the lower end wall due to the inclined orientation of the drum. Radial flume elements 80, inside the drum continuously scoop batches or portions of the aggregate material and water up, as shown in FIGS. 2 and 3, and deposit it on the collar 54 (FIG. 3) as each element reaches a point of about 135° from bottom dead center. The approximate 7° angle of inclination is important here too since this allows the collar 54 to intercept the falling material, as is evident. The material rolls and slides from the collar onto the tail screen 52 where the aggregate is dewatered and deposited into a chute or conveyor (not shown). The flume elements 80 thus provide the dual functions of assisting in agitating the wash water for thorough cleaning of the aggregate and pumping the aggregate and wash water of the drum. In FIG. 2, it can be seen that cylindrical drum 12 preferably comprises a carrier shell 74 housing a replaceable drum liner 76. Attached to the inside surface of the liner 76 are the spaced longitudinal agitator vanes 78. The radial flume elements 80 are attached to the inside of the end wall 16; it being understood that the ends of the vanes 78 clear the flume elements when the liner is in place. The longitudinal agitator vanes 78 are substantially L-shaped and preferably extend along the entire length of liner 76. The agitator vanes 78 are preferably secured to the liner 76 by bolting but may, if desired, be welded to the liner.

The flume elements 80, are preferably secured to wall 16 by welding and extend radially from liner 76 to outlet 18 on end wall 16. The radial flume elements 80 are easily accessible for service through the full opening of the intake end 81 (see FIG. 4), and the vanes 78 are easily accessible through the opposing end 82, when the liner is removed.

Referring to FIGS. 2 and 3, the operation of flume elements 80 and agitator vanes 78 for scrubbing the aggregate materials and pumping the aggregate and wash water to the tail screen 52 may be described in more detail. As drum 12 rotates counterclockwise, in the direction of the arrow in FIG. 2, the longitudinal agitator vanes 78 tumble and scrub the dirty aggregate material, by: (1) lifting elongated piles of the aggregate out of the wash water in the drum; (2) continuing to lift the aggregate up along the interior of the drum; and then (3) dropping the material back into the wash water. Aggregate not caught by the vanes 78 is tumbled end over end as the vanes push through the aggregate G accumulated at the bottom of the drum 12. As the process continues, the aggregate is continuously removed from the bottom of the drum so that all aggregate is completely cleaned by the time the outlet end wall 16 is reached. That is, the continuous tumbling of the aggregate G and dropping of the aggregate into water by vanes 78 provides a thorough scrubbing of the aggregate.

When the aggregate G intersects the plane of flume elements 80, at end wall 16, the elements 80 scoop batches of aggregate material and water for deposit to outlet 18, as mentioned above. For example, in FIGS. 2 and 3, radial flume element 80*a* is shown scooping through a quantity of aggregate G. As the flume element rotates with the interior of the drum: (1) the aggregate and wash water are lifted from the reservoir of wash water at the position, shown by flume element 80*b;* (2) the aggregate and wash water are brought up past the horizontal or 90° position, as shown by element 80*c;* and (3) then dumped into outlet 18 at element position 80*d*, about 135° from bottom dead center.

As shown in FIG. 3, the inclined orientation of the drum 12 insures that the aggregate and water strike collar 54 and flow onto tail screen 52 rather than tumble back into the interior of drum 12. Any aggregate or wash water that does reenter the drum is immediately scooped up by the flume elements 80 and pumped back to the outlet 18.

The radial flume elements 80 are imperforate so as to scoop both aggregate materials and water as drum 12 rotates. The flume elements 80, besides scooping aggregate materials and water for pumping to outlet 18, agitate the water throughout to prevent stagnation or freezing during cold water. I have found that as drum 12 rotates, the flume elements cut the surface of the water and provide an efficient continuous circulation of the wash water inside the drum. This continuous circulation also contributes to scrubbing of the dirty aggregate. The flume elements 80 also prevent freezing of the water even in extremely cold weather because the surface of the water, where ice formation first occurs is maintained in constant turbulence. This is in contrast to prior art apparatus that utilize drain apertures because most of the water movement in that case occurs near the drain apertures and little turbulence is created at the surface.

Following a run of washing of aggregate, it is desirable to empty drum 12. The operator simply cuts the feed of water and aggregate from inlet chute 22 while continuing rotation of drum 12. The remaining water and aggregate collected against end wall 16 by the inclined orientation of drum 12 is scooped up by radial flume elements 80 as the drum 12 rotates until the drum 12 is completely empty. In other words, the radial flume elements 80 automatically pump the leftover water and aggregate from the interior of the drum 12. Accordingly, at the end of an aggregate cleaning operation, the drum 12 does not have to be manually cleaned out of leftover aggregate and wash. There is no troublesome clogging of drain holes or manual cleaning since the flumes provide a positive pumping action. Because the leftover wash mixture is pumped out, there is no freezing after an over-night shut down period in freezing weather.

Referring to FIG. 4, it can be seen that drum liner 76 is cylindrical for seating inside carrier shell 74 and is removable from the carrier shell for servicing by simply sliding the liner longitudinally out (note arrow). The liner 76 contains the centrally disposed aperture 20 forming the inlet for drum 12. Should the longitudinal agitator vanes 78 or radial flume elements 80 require replacement, the liner is removed so that free access through openings 81, 82, respectively, is possible. The drum liner 76 is then reinserted into the carrier shell.

Drum liner 76 permits servicing without shutting down the apparatus 10. The liner 76, being standard to the apparatus, may be stocked on location. By inserting a new drum into the carrier shell while a used drum liner is being cleaned or serviced, the apparatus 10 is fully useable for cleaning aggregate. This substantially reduces downtime of the apparatus and increases operation efficiency.

Figure 5:
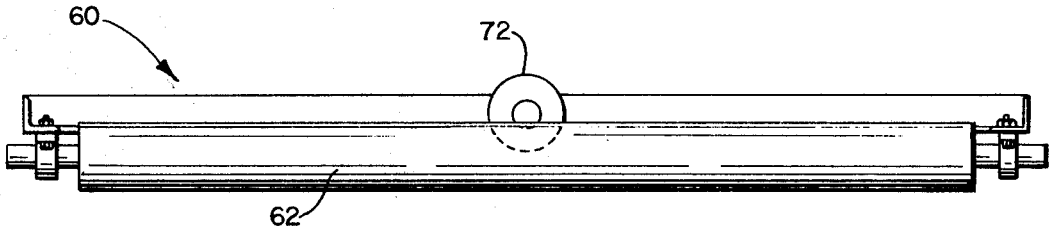
FIG. 5 is a top view of the tail screen cleaning attachment.
Figure 6:
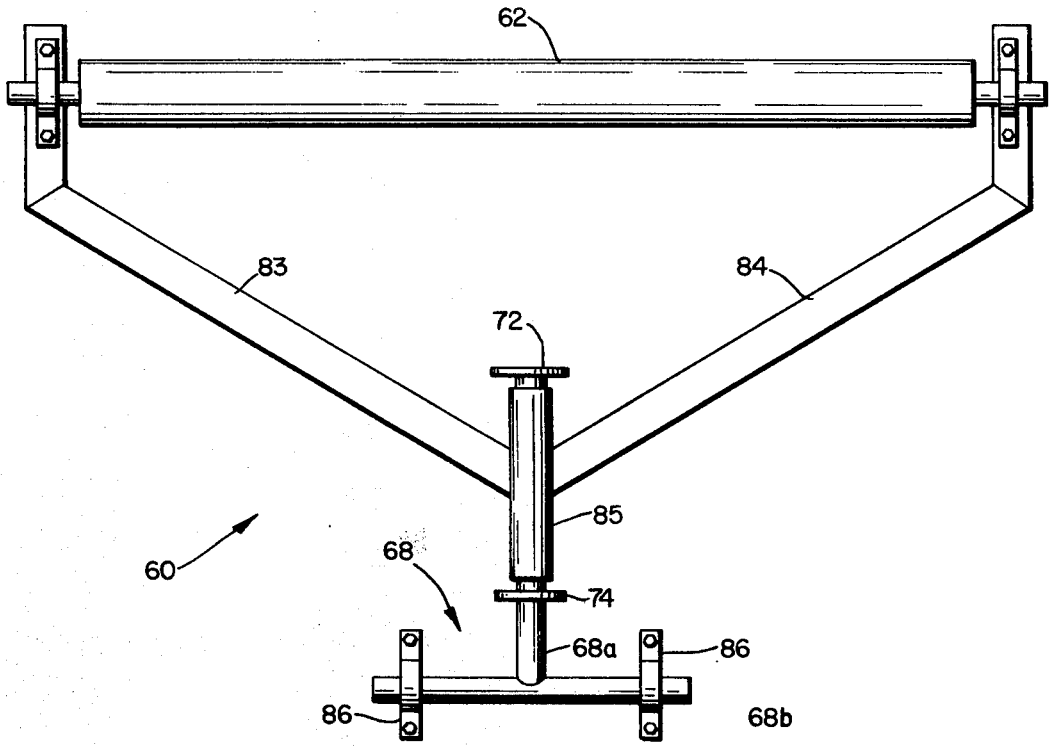
FIG. 6 is a front view of the tail screen cleaning attachment of FIG. 5.

As mentioned, cleaning roller assembly 60 is provided in engagement with the outer surface of tail screen 52 to remove any aggregate pieces that might become jammed in the mesh. Roller 62 pushes the aggregate pieces back through the tail screen mesh for release in a normal manner. Referring to FIGS. 5 and 6, the cleaning roller assembly 60 is shown in detail.

The assembly 60 comprises a fork-shaped body having outwardly extending arm members 83 and 84 attached to a collar 85. Roller 62 is rotatively attached to the ends of the arm members 83 and 84. Collar 85 is loosely coupled to a T member 68 at stem 68*a* and is bounded by washers 72 and 74. Crosspiece 68 of the T-shaped member is mounted to a stationary support, such as the side of collector chute 58 in FIG. 1 by pillow blocks and bearings 86. T-member 68 is thus freely rotatable about the axis of crosspiece 68*b* while collar 85 is freely rotatable about stem 68*a* thereby allowing universal joint action permitting roller 62 to yield in all directions and accommodate irregularities of tail screen 52.

Roller 62 is maintained against the outer surface of the tail screen 52 simply by the weight of the roller. I have found that the weight of the roller is sufficient for dislodging aggregate pieces from tail screen 52 and the universal joint mounting arrangement prevents damage to the roller 62 or tail screen 52.

In view of the foregoing description of the invention and the attendant advantages of the preferred embodiment, it can be seen that an efficient aggregate materials washing apparatus 10 has been provided wherein dirty aggregate materials are tumbled and scrubbed for thorough washing and very little maintenance of the apparatus is required. The internal elements of drum 12 are easily accessible and serviced by removing liner 76. The pumping action of the imperforate radial flume elements 18 keeps the wash water in constant agitation to prevent stagnation. The drum 12 is self-emptying by the pumping action of the flume elements 80 so that no residual is left for freezing overnight in cold weather. The cleaned aggregate material is dewatered by means of tail screen 52 mounted to collar 54 at the outlet 18 of drum 12. Even the tail screen 52 is self-cleaning by means of cleaning roller 62 that contacts the outside surface of the tail screen for release of lodged aggregate materials.

In this disclosure, there is shown and described only the preferred embodiments of the invention, but, as aforementioned it is to be understood that the invention is capable of use in various other combinations and environments and is capable of changes or modifications within the scope of the inventive concept as expressed herein.

What is claimed is:

1. Aggregate materials washing apparatus comprising:

a cylindrical drum including an interior wall, and first and second end walls containing respectively an outlet and an inlet;

means for infeeding aggregate and wash fluid to said drum at said inlet;

said drum being inclined from the horizontal to provide a flow of the aggregate and wash toward the outlet;

power means for rotating said drum about its longitudinal axis;

a plurality of longitudinally extending agitator elements spaced around the interior wall of said drum for tumbling the aggregate during rotation of the drum;

a plurality of imperforate, scoop-shaped pumping elements extending radially between the interior wall and said outlet, said pumping elements scooping up both wash fluid and aggregate from said interior wall below said outlet and transferring the fluid and aggregate to said outlet during rotation of said drum and a replaceable liner adapted for lining the interior of said drum, said liner carrying said agitating elements.

2. The apparatus of claim 1 wherein said pumping elements have a substantially semi-circular cross-section and abut said first end wall.

3. The apparatus of claim 1 including a cylindrical outlet screen positioned in open communication with said outlet for defluidizing the cleaned aggregate material pumped by said radial pumping elements.

4. The apparatus of claim 3 wherein said outlet screen includes self-cleaning means for releasing aggregate pieces lodged in said screen.

5. The apparatus of claim 4 wherein said self-cleaning means includes a cleaning roller contacting the outside of said screen.

6. The apparatus of claim 5 including a universal joint supporting said roller, said roller thereby yielding to irregularities in said screen.

7. The apparatus of claim 1 including a sprocket disposed around the girth of said drum; and said power means includes a chain driven in tangential engagement with said sprocket.

8. The apparatus of claim 1 wherein said means for supporting includes guide roll means for vertically and longitudinally stabilizing said drum.

9. The apparatus of claim 8 including a guide flange disposed around the girth of said drum, said guide roll means including a guide roller contacting said guide flange for supporting said drum along its longitudinal axis.

* * * * *